US009340744B2

(12) United States Patent
Marsh et al.

(10) Patent No.: US 9,340,744 B2
(45) Date of Patent: May 17, 2016

(54) DETERGENT MODIFICATION

(71) Applicant: Infineum International Limited, Abingdon (GB)

(72) Inventors: Adam P. Marsh, Witney (GB); Oliver J. Delamore, Abingdon (GB); Myriam Yagoubi, Oxford (GB)

(73) Assignee: INFINEUM INTERNATIONAL LIMITED (GB)

( * ) Notice: Subject to any disclaimer, the term of this patent is extended or adjusted under 35 U.S.C. 154(b) by 206 days.

(21) Appl. No.: 13/934,255

(22) Filed: Jul. 3, 2013

(65) Prior Publication Data

US 2014/0130757 A1 May 15, 2014

(30) Foreign Application Priority Data

Jul. 6, 2012 (EP) ..... 12175238

(51) Int. Cl.
*C10M 159/22* (2006.01)
*C10M 135/08* (2006.01)

(52) U.S. Cl.
CPC ..... *C10M 135/08* (2013.01); *C10M 159/22* (2013.01); *C10M 2207/028* (2013.01); *C10N 2230/04* (2013.01); *C10N 2230/10* (2013.01); *C10N 2230/12* (2013.01); *C10N 2240/10* (2013.01); *C10N 2260/06* (2013.01)

(58) Field of Classification Search
CPC ..... C10M 135/08; C10M 159/22; C10M 2207/028; C10N 2230/04; C10N 2230/10; C10N 2230/12; C10N 2240/10; C10N 2260/06
USPC ..... 508/200, 574
See application file for complete search history.

(56) References Cited

U.S. PATENT DOCUMENTS

| | | | | |
|---|---|---|---|---|
| 2,989,466 | A * | 6/1961 | Abbott | 508/565 |
| 5,587,451 | A * | 12/1996 | Athey et al. | 528/345 |
| 5,677,270 | A * | 10/1997 | Small et al. | 508/574 |
| 5,910,468 | A * | 6/1999 | Dohhen et al. | 508/332 |
| 2003/0004069 | A1* | 1/2003 | Hammond et al. | 508/460 |
| 2004/0121919 | A1* | 6/2004 | Gao | 508/363 |
| 2011/0124539 | A1 | 5/2011 | Sinquin et al. | |
| 2011/0239978 | A1* | 10/2011 | Dambacher et al. | 123/196 R |

FOREIGN PATENT DOCUMENTS

EP 1518861 A2 3/2005

OTHER PUBLICATIONS

Renner, Rebecca, "European Bans on Surfactant Trigger Transatlantic Debate", Environmental Science & Technology, 1997, vol. 31, No. 7,pp. 316-320.

* cited by examiner

*Primary Examiner* — James Goloboy

(57) ABSTRACT

An overbased sulphurised calcium phenate detergent additive, made from an aldylphenol, has oxyalkylated phenolic functional groups from unreacted alkylphenol starting material.

11 Claims, No Drawings

DETERGENT MODIFICATION

FIELD OF THE INVENTION

This invention relates to overbased sulphurised calcium phenate detergents.

BACKGROUND OF THE INVENTION

Sulphurised calcium alkyl phenate detergents are well known additive components for internal combustion engine crankcase lubricating oil compositions. However, alkylphenols used in their manufacture have some undesirable properties, such as giving rise to corrosion. Furthermore, certain alkylphenols (nonylphenol, tetrapropenylphenol) are classified as reproductive toxins.

Various routes are known in the art for manufacturing such phenate detergents and they result in a multi-constituent product that comprises mainly a colloidal system (a calcium carbonate core stabilized by a sulphurised phenate surfactant) with other species in an oil medium. However, the alkylphenol starting materials are not completely consumed in the reaction to produce the final detergent.

Levels of unreacted alkylphenol in the final detergent may, for example, range from 2 to 20% and, at these levels, may constitute a problem for the reasons indicated above. There is therefore a need to reduce these levels, but without introducing performance debits.

The prior art describes ways of solving the problem, but they are generally expensive to carry out. WO 2011066115 describes a method of making phenate using alkylphenols synthesised with alkyl chains derived from isomerized linear olefins. These alkylphenol products are made by alkylation of phenol with a partially-branched olefin that had been prepared from a linear olefin by a generalised isomerization step; their use for the manufacturing of detergents that are substantially free of endocrine disruptive chemicals is described.

Also, a number of references describe the synthesis of alkylphenols to form structures compositionally different from nonylphenol and tetrapropenylphenol, and some references further describe the synthesis of phenates from these materials. U.S. Pat. Nos. 5,318,710, 5,320,762 and 5,320,763 describe Group II metal overbased sulphurised alkylphenol compositions derived from alkylphenols enriched in alkylphenol containing substantially straight chain alkyl chains. WO 2010014829, WO 2011096920, EP 1108704, US 20080269351 and US 20110118160 are all further examples of attempts at producing an alkyl phenol that is structurely different from tetrapropenylphenol and nonylphenol. It is stated in WO 2011096920 that the composition produced will reduce the reprotoxicological activity of the additive, compared with additives based on propylene tetramer.

Additionally, US 20090143264 is an example in the art describing a low tetrapropenylphenol phenate product whilst continuing to use it as the alkylphenol feedstock, stating that HBN Phenates with a residual TPP content of less than 2 mass % have been prepared.

SUMMARY OF THE INVENTION

The invention meets the above problem by post-treatment of sulphurised calcium alkyl phenate detergents with alkylene carbonates to react with phenolic hydroxyl groups in unreacted alkyl phenols and possibly, also in the surfactant phenates. It is found that "capping" of phenolic groups by such reaction is successful and may be "tailored" to be extensive. It is also found that performance debits do not generally arise, and that some properties of the detergents may be enhanced.

The invention provides, in a first aspect, an overbased sulphurised calcium phenate detergent additive made from an alkylphenol and comprising a colloidal system in which a calcium carbonate core is stabilized by a sulphurised phenate surfactant in a liquid medium, where phenolic functional groups in unreacted alkylphenol starting material are oxyalkylated to provide oxyalkyl groups of formula:

—$(R^1O)_n$—, where $R^1$ is ethylene, propylene or butylene and n is independently from 1 to 10.

The invention provides, in a second aspect, a method of making a detergent of the first aspect of the invention comprising reacting an overbased sulphurised calcium phenate with ethylene carbonate, propylene carbonate or butylene carbonate.

The invention provides, in a third aspect, an overbased calcium phenate detergent obtainable by the method of the second aspect of the invention.

The invention provides, in a fourth aspect, a lubricating oil composition comprising or made by mixing:

(A) an oil of lubricating viscosity in a major amount; and (B) as an additive component, in a minor amount, a detergent of the first or third aspects of the invention.

The invention provides, in a fifth aspect, a method of lubricating surfaces of an internal combustion engine during its operation which comprises (i) providing a lubricating oil composition of the fourth aspect of the invention to the crankcase of the internal combustion engine;

(ii) providing a hydrocarbon fuel in the combustion chamber of the engine; and (iii) combusting the fuel in the combustion chamber.

In this specification, the following words and expressions, if and when used, have the meanings ascribed below:

"Active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means 50 mass % or more of a composition;

"minor amount" means less than 50 mass % of a composition;

"TBN" means total base number as measured by ASTM D2896.

Furthermore in this specification, if and when used:

"calcium content" is as measured by ASTM D4951;

"phosphorus content" is as measured by ASTM D5185;

"sulphated ash content" is as measured by ASTM D874;

"sulphur content" is as measured by ASTM D2622;

"KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to one or more aspects of the invention, will now be discussed in more detail below.

Overbased Sulphurised Calcium Phenate Detergent Additive

As examples of the above additives there may be mentioned those of TBN's in the ranges 50 and 400.

The detergent additive may be an additive where phenate is the sole surfactant.

Also, it may be a complex/hybrid detergent prepared from a mixture of more than one metal surfactant, where at least one of those surfactants is a phenate and at least one of the surfactants is not a phenate. Such a complex detergent is a hybrid material in which the surfactant groups are incorporated during the overbasing process. Examples of complex detergents are described in the art (see, for example, WO 97/46643, WO 97/46644, WO 97/46645, WO 97/46646 and WO 97/46647). The other surfactant or surfactants may for example be sulfonate or salicylate or both.

As examples of alkylphenol starting materials there may be mentioned the following:

(A) Phenols prepared via the alkylation of phenol with propylene-based alkenes. These are characterized by branched-chain para alkyl substitution where attachment of the chain to the benzene ring is via C-2 or C-3 carbon atoms.

(B) Phenols derived from cashew nut shell liquid (CNSL).

A characteristic structural feature of the alkyl phenol materials (B) is meta hydrocarbyl-substitution of the aromatic ring where the substituent is attached to the ring at its first (C1) carbon atom. This structural feature is not available by chemical alkyl phenol synthesis such as the Friedel-Crafts reaction of phenol with olefins. The latter typically gives mixtures of ortho and para alkyl phenols (but only around 1% of meta alkyl phenols), and where attachment of the alkyl group to the aromatic ring is at the second (C2) or higher carbon atom.

Cardanol, the product obtained by distilling technical CNSL, typically contains 3-pentadecylphenol (3%); 3-(8-pentadecenyl)phenol (34-36%); 3-(8, 11-pentadecadienyl) phenol (21-22%); and 3-(8, 11, 14-pentadecatrienyl)phenol (40-41%), plus a small amount of 5-(pentadecyl) resorcinol (c. 10%), also referred to as cardol. Technical CNSL contains mainly cardanol plus some polymerized material. Cardanol may therefore be expressed as containing significant amounts of meta-linear hydrocarbyl substituted phenol, where the hydrocarbyl group has the formula $C_{15}H_{25-31}$ and is attached to the aromatic ring at its first carbon atom (C1).

Thus, both cardanol and technical CNSL contain significant quantities of material having long linear unsaturated side chains and only small quantities of material with long linear saturated side chains. The present invention may employ material where a major proportion, preferably all of the phenol, contains material with long linear saturated side chains. Such latter material is obtainable by hydrogenating cardanol; a preferred example is 3-(pentadecyl)phenol, where the pentadecyl group is linear and is attached to the aromatic ring at its first carbon atom. It may constitute 50 or more, 60 or more, 70 or more, 80 or more, or 90 or more, mass % of the additive of the invention. It may contain small quantities of 3-(pentadecyl)resorcinol. The invention does not include use of technical CNSL.

Generally, the invention is applicable to a range of detergents where various types of alkylphenol have been used as starting material and are present in the detergent as unreacted material e.g. in terms of their structure and methods of manufacture.

Preferably, more than 25, such as more than 50, mole % of the phenolic functional groups are mono-oxylated. The oxyalkylated unreacted phenol may, for example, have the formula

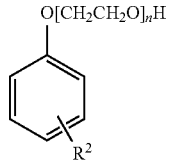

where n is independently 1-10, and $R^2$ is a hydrocarbyl group having 9-100, preferably 9-70, most preferably 9-50, carbon atoms.

Also, the phenolic functional groups in the sulphurised phenate surfactant may be oxyaklylated to provide oxyalkyl groups of formula —($R^1$O)n—, where $R^1$ is ethylene, propylene or butylene and n is independently from 1 to 10.

Where the phenate surfactant is oxyalkylated, it may, for example, have repeating units of the formula

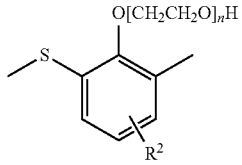

where n and $R^2$ are defined as above.

In the detergent additives of the invention, more than 30, such as more than 40, such as more than 50, such as more than 60, such as more than 70, such as more than 80, such as more than 90, such as more than 95, mole % of the phenolic functional groups in unreacted alkylphenol starting material may, for example, be oxyalkylated. The detergent additives of the invention may include less than 5, such as less than 1, such as less than 0.5, such as less than 0.1, mole % of unreacted alkylphenol starting material.

Method

The detergent additives of the invention are made, as indicated above, by reacting an overbased sulphurized calcium phenate with ethylene carbonate, propylene carbonate or butylene carbonate. The reaction maybe carried out by heating a sulphurised calcium alkyl phenate detergent with the required amount of one of the above-mentioned carbonates above 100° C. (typically around 150 to 170° C.) with or without a solvent, until the carbonate has been fully reacted.

The overbased sulphurised calcium phenate is reacted with the alkylene carbonate after overbasing has been completed. Overbasing is preferably conducted using carbon dioxide. Overbasing is preferably performed at temperatures above 110° C., which will also remove any water present. Alternatively, water and any other solvents present can be removed using vacuum distillation. It is desirable, and preferably essential, that any water is removed before the overbased sulphurized calcium phenate is reacted with the alkylene carbonate.

The overbased sulphurized calcium phenate is preferably prepared using calcium oxide, which produces less water than calcium hydroxide.

It is essential to the invention that the alkylene carbonate does not react with water. This is achieved by adding the alkylene carbonate after the overbasing step (i.e. the addition of carbon dioxide) has finished and any water present in the overbased sulphurized calcium phenate has been removed. The alkylene carbonate is therefore added as a post-treatment step after the carbonation step has been completed.

Lubricating Oil Composition

This, as indicated above, is an aspect of the invention.

The oil of lubricating viscosity provides a major proportion of the composition and may be any oil suitable for lubricating an internal combustion engine.

It may range in viscosity from light distillate mineral oils to heavy lubricating oils. Generally, the viscosity of the oil ranges from 2 to 40 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogues and homologues thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed C3-C8 fatty acid esters and C13 oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from C5 to C 12 monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from esterification and used without further treatment, are unrefined oils. Refined oils are similar to unrefined oils except that the oil is further treated in one or more purification steps to improve one or more properties. Many such purification techniques, such as distillation, solvent extraction, acid or base extraction, filtration and percolation, are known to those skilled in the art. Re-refined oils are obtained by processes similar to those used to provide refined oils but begin with oil that has already been used in service. Such re-refined oils are also known as reclaimed or reprocessed oils and are often subjected to additional processing using techniques for removing spent additives and oil breakdown products.

The American Petroleum Institute (API) publication "Engine Oil Licensing and Certification System", Industry Services Department, Fourteenth Edition, December 1996, Addendum 1, December 1998 categorizes groups of base stocks. As an example of an oil of lubricating viscosity that may be used in a lubricating oil composition of the present invention, there may be mentioned an oil containing 50 mass % or more of a basestock containing greater than or equal to 90% saturates and less than or equal to 0.03% sulphur or a mixture thereof. Preferably, it contains 60, such as 70, 80 or 90, mass % or more of said basestock or a mixture thereof. The oil of lubricating viscosity may consist or substantially consist of said basestock or a mixture thereof.

Oil of lubricating viscosity may provide 50 mass % or more of the composition. Preferably, it provides 60, such as 70, 80 or 90, mass % or more of the composition.

The composition may comprise, in addition to the detergent additive of the invention, one or more additive components, different from the additive of the invention, selected from one or more ashless dispersants, detergents, corrosion inhibitors, antioxidants, pour point depressants, antiwear agents, friction modifiers, demulsifiers, antifoaming agents and viscosity modifiers.

The lubricating oil composition may, for example, be a marine diesel cylinder lubricant ("MDCL") or a trunk piston engine oil ("TPEO").

Engines

The detergent additives of the invention may be used in lubricants for a range of internal combustion engines (spark-ignited or compression ignited) such as motor vehicle engines and marine engines. Of the latter, there may be mentioned two-stroke marine diesel cross-head engines and marine trunk piston engines.

EXAMPLES

The present invention is illustrated by but in no way limited to the following examples.

Calcium Phenate Detergents

Two classes of calcium phenate detergents were used, made from different alkylphenol sources.

Phenates 1 were made from tetrapropenylphenol, characterized by predominantly para alkyl-substitution with a branched alkyl chain attached at the C2 or C3 positions.

Phenates 2 were made from hydrogenated distilled cashew nut shell liquid (mainly 3-pentadecylphenol), characterized by predominantly meta alkyl-substitution with a linear alkyl chain attached at the C1 position.

Each class consisted of two variants: a low TBN variant (e.g. Phenates 1 LBN), and a high BN variant (e.g. Phenates 1 HBN). Each variant was tested in uncapped form (as a reference) and when capped with various proportions of ethylene carbonate, as indicated in the tables in the Results section below.

Method of preparation: The sulphurisation and carbonation steps were performed either in seperate stages (for the 'Phenates 2') or stimultaneously (for 'Phenates 1'). The temperature range for the sulphurisation and carbonation steps was between 115 and 215° C. The reactors used in all cases allowed by-products, such as water, to be removed from the reaction via distillation throughout the sulphurisation and carbonation stages. Additional processing (vacuum distillation) once the carbonation step was completed ensured any remaining water was removed along with the reaction solvents.

Phenates 1 (LBN and HBN) synthesised using tetrapropenylphenol were obtained from the Infineum manufacturing plant (Bayway), and were synthesised via the following procedure:

- Terapropenylphenol, isodecanol (reaction solvent), ethylene glycol and an antifoam agent were charged to the reactor and heated to 50° C.
- This mixture was heated up to 90° C. during which elemental sulphur and calcium oxide are charged to the mixture.
- Once at 90° C., further ethylene glycol and base oil are charged as required and the temperature increased to 115° C.
- $CO_2$ addition is started at 115° C. and added for between 6 and 8 hours as the temperature is raised to between 190 and 215° C.
- Once carbonation is complete, the reaction mixture is heated to, or held at, 210-215° C. and vacuum applied to remove reaction solvents and water.

Phenates 2 (LBN and HBN) synthesised using hydrogenated distilled cashew nut shell liquid were synthesised in the laboratory using the following method:

- Preheated hydrogenated CNSL, isodecanol (reaction solvent), base oil (reaction solvent and diluent), an antifoam agent, elemental sulphur (added at 50° C.) and CaO (calcium oxide) were charged to the reactor.
- This was heated up to 140° C. in 30 minutes with stirring throughout.
- EG (ethylene glycol—reaction promotor and solvent) was added drop wise at 140° C.
- Heating was continued up to 175° C. and held for 2 hours.
- Co-surfactant and additional CaO and EG were charged.
- Water was removed in 25 minutes.
- $CO_2$ was added at 175° C. over between 2 and 6 hours.
- The reaction mixture was heated up to 210° C. and vacuum applied to remove reaction solvents and water.

A sample of the overbased sulphurised calcium phenate detergent was weighed into a reactor with 1,3-dioxolan-2-one (ethylene carbonate) and heated to 165° C. over approximately 1 hour. The reaction was maintained at 165° C. until the ethylene carbonate had been fully reacted, which was ascertained via Infra-Red. Once complete, the reaction product was allowed to cool.

Filtration or centrifugation, and dilution in oil (if required) completed the product synthesis in each case, and was performed either after the completion of the vacuum distillation or after the reaction with ethylene carbonate had reached completion.

RESULTS

Analysis

Capped and uncapped variants were assessed by measuring their % capping (by HPLC), TBN, KV100 and 24 hour heptane stability. The results are shown in Table 1 below:

EC=ethylene carbonate

DDP=dodecylphenol

PDP=3-pentadecylphenol

Ratios of the above are equivalency ratios with the calculated level of alkylphenol present in the sulphurised calcium phenate detergent (mass % in starting materials is shown in Table 1 below).

TABLE 1

| Sample | Ratio EC:DDP | % | TBN | KV100 | Stability |
|---|---|---|---|---|---|
| Phenates 1. LBN (starting alkylphenol content = 10%) | | | | | |
| Ref 1 | 0 | — | 142 | 45.98 | 0.1 |
| 1 | 1:1 | 35 | 138 | — | 0.06 |
| 2 | 2:1 | 86 | 140 | 41.94 | 0.06 |
| 3 | 3:1 | 95 | 135 | 30.11 | 0.1 |
| 4 | 5:1 | >99 | 132 | 31.41 | 0.1 |
| Phenates 2. LBN (starting alkylphenol content = 11.5%) | | | | | |
| Ref 2 | 0 | — | 160 | — | 0.04 sed, 0.2 haze |
| 5 | 1:1 | 14 | — | — | 0.05 |
| 6 | 2:1 | 39 | 148 | — | 0.06 |
| 7 | 5:1 | >98 | — | — | 0.08 |
| Phenates 1. HBN (starting alkylphenol content = 15%) | | | | | |
| Ref 3 | 0 | — | 254 | 257 | 0.1 |
| 8 | 1:1 | ~50 | 245 | 208 | 0.1 |
| 9 | 2:1 | ~98 | 250 | 128 | 0.06 |
| 10 | 3:1 | >99 | 234 | 175.8 | 0.12 |
| Phenates 2. HBN (starting alkylphenol = 9.4%) | | | | | |
| Ref 4 | 0 | — | 257 | — | 0.02 |
| 11 | 3:1 | 85 | 245 | — | 0.002 |
| 12 | 5:1 | >99 | 240 | — | 0.04 |

A dash indicates that a property was not measured.

The above data show that that it is possible to achieve significant capping without adverse effect on properties such as viscosity and stability. In some cases those properties are improved. The data also show that the capping reaction is selective with regard to the phenol source. Thus, more EC is needed to achieve say 95% capping when the phenate is PDP-based than when the phenate is DDP-based. However, it appears possible to cap at different levels in order to achieve a required performance.

Bench Test Data: Panel Coker Test

Certain of the test phenates were blended into formulations at a charge of 9.125%; the formulations were identical other than in respect of the identity of the phenates. The formulations were subjected to the panel coker test, described as follows:

Lubricating oils may degrade on hot engine surfaces and leave deposits which will affect engine performance; the panel coker test simulates typical conditions and measures the tendency of oils to form such deposits. The oil under test is splashed onto a heated metal plate by spinning a metal comb-like splasher device within a sump containing the oil. At the end of the test period, deposits formed may be assessed by 'rating' of the plate's appearance.

An overview of the test method is as follows:

225 ml of the oil is heated in an oil bath to 100° C.

A heated aluminium panel is located above the oil bath at an incline, maintained at a temperature of 320° C.

The oil is splashed for 15 seconds against this panel, followed by no splashing for 45 seconds.

This cycle of intermittent splashing is continued for 1 hour.

The panel is then rated for discolouration.

The rating is measured, by a system involving a computer-controlled photographic device (a "Cotateur"). The program looks at both the degree of discolouration and area covered in order to offer a rating between 0 and 10.

A higher value indicates better performance.

The results are summarised in TABLE 2 below.

TABLE 2

| Sample | Rating | Deposit |
|---|---|---|
| Phenates 1. HBN (starting alkylphenol content = 15%) | | |
| Ratio EC:DDP | | |
| Ref 5 0 | 5.1 | 0.0418 |
| 13 1:1 | 5.43 | 0.0403 |
| 14 2:1 | 5.87 | 0.0224 |
| 15 3:1 | 5.23 | 0.0376 |
| Phenates 2. HBN (starting alkylphenol content = 9.4%) | | |
| Ratio EC:PDP | | |
| Ref 6 0 | 6.76 | 0.0244 |
| 16 3:1 | 6.49 | 0.0259 |
| 17 5:1 | 6.89 | 0.0241 |

The TABLE 2 data show no adverse effect on panel coker results arising from the capping and, in some cases, improvement is indicated.

Corrosion Testing: Uncapped and Capped Phenols 3-pentadecylphenol and tetrepropenylphenol and their respective ethylene carbonate-capped derivatives were each blended into identical lubricating oil compositions at a treat rate of about 0.3 mass %. The compositions were subjected to a high temperature corrosion bench test according to ASTM D6594. The results are shown in the table below:

| Phenol (Uncapped/Capped) | Pb (ppm) | Ca (ppm) |
|---|---|---|
| 3-pentadecylphenol | 164 | 4 |
| EC-capped 3-pentadecylphenol | 16 | 4 |
| tetrapropenylphenol | 33 | 4 |
| EC-capped tetrapropenyphenol | 12 | 5 |

The results show that capping significantly improved lead corrosion performance; and that capping did not deleteriously affect copper corrosion performance.

What is claimed is:

1. An overbased sulphurised calcium phenate detergent additive composition made from an alkylphenol, said composition comprising a colloidal system in which a calcium carbonate core is stabilized by a sulphurised phenate surfactant in a liquid medium, and an amount of unreacted alkylphenol starting material, where more than 25 mole % of the phenolic functional groups in said unreacted alkylphenol starting material are oxyalkylated to provide oxyalkyl groups of formula —$(R^1O)_n$—, where R' is ethylene, propylene or butylene and n is independently an integer from 1 to 10, by reacting said composition with ethylene carbonate, propylene carbonate or butylene carbonate; the reaction optionally taking place after any water present in said has been removed.

2. The detergent additive composition of claim 1 where more than 50 mole % of the phenolic functional groups in said unreacted alkylphenol starting material are mono-oxyalkylated.

3. The detergent additive composition of claim 1 where the oxyalkylated unreacted phenol has the formula

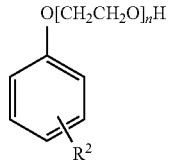

where $R^2$ is a hydrocarbyl group having 9-100 carbon atoms, and n is independently an integer from 1 to 10.

4. The detergent additive composition of claim 3 where $R^2$ is a branched chain para-substituent.

5. The detergent additive composition of claim 3 where $R^2$ is a straight-chain meta-substituent.

6. The detergent additive composition of claim 5 where the alkylphenol is distilled, hydrogenated cashew nut shell liquid.

7. The detergent of claim 1 including less than 5 mole % of said unreacted alkylphenol starting material.

8. The detergent additive composition of claim 1 in the form of a complex/hybrid detergent prepared from a mixture of more than one metal surfactant where at least one of the surfactants is a phenate and at least one of the surfactants is not a phenate.

9. A lubricating oil composition comprising or made by mixing:

(A) an oil of lubricating viscosity in a major amount; and (B) as an additive component, in a minor amount, a detergent additive composition as claimed in claim 1.

10. The lubricating oil composition of claim 9 further comprising one or more additive components, different from (B), selected from one or more ashless dispersants, detergents, corrosion inhibitors, antioxidants, pour point depressants, antiwear agents, friction modifiers, demulsifiers, antifoaming agents and viscosity modifiers.

11. A method of lubricating surfaces of an internal combustion engine during its operation which comprises (i) providing a lubricating oil composition of claim 9 to the crankcase of the internal combustion engine;

(ii) providing a hydrocarbon fuel in the combustion chamber of the engine; and (iii) combusting the fuel in the combustion chamber.

* * * * *